US006346203B1

(12) United States Patent
Robin et al.

(10) Patent No.: US 6,346,203 B1
(45) Date of Patent: Feb. 12, 2002

(54) METHOD FOR THE SUPPRESSION OF FIRE

(75) Inventors: Mark L. Robin, West Lafayette; W. Douglas Register, Lafayette, both of IN (US); Thomas F. Rowland, El Dorado, AR (US)

(73) Assignee: PCBU Services, Inc., Wilmington, DE (US)

( * ) Notice: Subject to any disclaimer, the term of this patent is extended or adjusted under 35 U.S.C. 154(b) by 0 days.

(21) Appl. No.: 09/503,822

(22) Filed: Feb. 15, 2000

(51) Int. Cl.[7] ..... A62D 1/08; A62D 1/00; A62C 35/02

(52) U.S. Cl. ..... 252/8; 252/3; 169/46; 169/47; 169/9; 169/19; 169/11

(58) Field of Search ..... 252/8, 3, 4; 169/46, 169/47, 6, 9, 12, 71, 85, 19.11

(56) References Cited

U.S. PATENT DOCUMENTS

| | | | | |
|---|---|---|---|---|
| 3,804,759 A | | 4/1974 | Becker et al. | 252/8 |
| 5,141,654 A | | 8/1992 | Fernandez | 252/8 |
| 5,340,490 A | | 8/1994 | Decaire et al. | 252/67 |
| 5,615,742 A | * | 4/1997 | Robin et al. | 169/45 |
| 5,899,275 A | * | 5/1999 | Okamoto et al. | 169/20 |
| 5,934,380 A | * | 8/1999 | Finnerty et al. | 169/46 |
| 6,065,547 A | * | 5/2000 | Ellis, Jr. et al. | 169/89 |
| 6,112,822 A | | 9/2000 | Robin et al. | 169/46 |

FOREIGN PATENT DOCUMENTS

| | | |
|---|---|---|
| EP | 0 617 983 A1 | 5/1994 |
| JP | 10 005367 A | 1/1998 |
| WO | WO 92/16597 | 1/1992 |
| WO | WO 93/15794 | 8/1993 |

OTHER PUBLICATIONS

Robin, M., "Halogenated Fire Suppression Agents", *ACS Symposium Series 611 Halon Replacements Technology and Science*, Miziolek, A.W. & Tsang. W., eds., American Chemical Society, Washington, DC 1995, pp. 85–98.

Wysocki, T. and Christensen, B., "Inert Gas Fire Suppression Systems Using IG541 (Inergen) Solving the Hydraulic Calculation Problem", Proceedings of the 1996 Halogen Options Technical Working Conference, Albuquerque, New Mexico, May 7–9, 1996, pp. 63–74.

Robin, M.L. and Rowland, T.F., "Development Of A Standard Cup–Burner Apparatus: NFPA And ISO Standard Methods", 1999 Halon Options Technincal Working Conference, Albuquerque, New Mexico, Apr. 27–29, 1999, pp. 284–292.

Webb, Pual—Bioastronautics Data Book, NASA SP–3006, NASA 1964, p. 5.

* cited by examiner

*Primary Examiner*—Joseph D. Anthony
(74) *Attorney, Agent, or Firm*—Marshall, Gerstein, & Borun

(57) ABSTRACT

A method for suppressing a fire at a burning material comprising delivering to said burning material (a) an inert gas and (b) a gaseous compound selected from the group consisting of a hydrofluorocarbon, an iodofluorocarbon, and a mixture thereof, gases (a) and (b) being delivered in a combined concentration sufficient to extinguish the fire.

23 Claims, No Drawings

METHOD FOR THE SUPPRESSION OF FIRE

FIELD OF THE INVENTION

The present invention relates. to the field of fire extinguishing compositions and methods for delivering a fire extinguishing composition to or within a protected hazard area.

DESCRIPTION OF THE PRIOR ART

Certain halogenated hydrocarbons have been employed as fire extinguishants since the early 1900's. Prior to 1945, the three most widely employed halogenated extinguishing agents were carbon tetrachloride, methyl bromide and bromochloromethane. For toxicological reasons, however, the use of these agents has been discontinued. Until only recently, the three halogenated fire extinguishing agents in common use were the bromine-containing compounds, Halon 1301 ($CF_3Br$), Halon 1211 ($CF_2BrCl$) and Halon 2402 ($BrCF_2CF_2Br$). One of the major advantages of these halogenated fire suppression agents over other fire suppression agents such as water or carbon dioxide is the clean nature of their extinguishment. Hence, the halogenated agents have been employed for the protection of computer rooms, electronic data processing facilities, museums and libraries, where the use of water for example can often cause more secondary damage to the property being protected than the fire itself causes.

Although the above named bromine and chlorine-containing compounds are effective fire fighting agents, those agents containing bromine or chlorine are asserted to be capable of the destruction of the earth's protective ozone layer. For example, Halon 1301 has an Ozone Depletion Potential (ODP) rating of 10, and Halon 1211 has an ODP of 3. As a result of concerns over ozone depletion, the production and sale of these agents after Jan. 1, 1994 is prohibited under international and United States policy.

It is therefore an object of the present invention to provide a method for extinguishing fires which does not employ bromine or chlorine-containing agents and which does not lead to the depletion of stratospheric ozone.

The use of hydrofluorocarbons (HFCs), for example 1,1,1,2,3,3,3-heptafluoropropane ($CF_3CHFCF_3$), as fire extinguishing agents has been proposed only recently (see for example, M. Robin, "Halogenated Fire Suppression Agents," in Halon Replacements, A. W. Miziolek and W. Tsang, eds., ACS Symposium Series 611, ACS, Washington, D.C., 1995). Since the hydrofluorocarbons do not contain bromine or chlorine, the compounds have no effect on the stratospheric ozone layer and their ODP is zero. As a result, hydrofluorofluorocarbons such as 1,1,1,2,3,3,3-heptafluoropropane and pentafluoroethane ($CF_3CF_2H$) are currently being employed as environmentally friendly replacements for the Halons in fire suppression applications.

The hydrofluorocarbon fire suppression agents are not as efficient on a weight basis as the Halon agents and hence increased weights of the hydrofluorocarbon agents are required to protect a given space; in some cases the weight of hydrofluorocarbon agent required is twice that of the Halon agent. A further disadvantage of the hydrofluorocarbon fire suppression agents compared to the Halon agents is their relatively high cost. The relatively high agent cost and lowered efficiency associated with the hydrofluorocarbon fire suppression agents leads to suppression system costs which are much higher compared to systems employing the Halon agents.

It is therefore a further object of the present invention to provide a fire suppression method which reduces the amount of hydrofluorocarbon fire suppression agent required for fire suppression, hence reducing the overall cost of the fire suppression system compared to conventional hydrofluorocarbon fire suppression systems.

When employed for the extinguishment of very large fires, the hydrofluorocarbon fire suppression agents react in the flame to form various amounts of the decomposition product HF, the relative amounts formed depending on the particular fire scenario. In larger quantities, HF can be corrosive to certain equipment and also poses a threat to personnel.

It is therefore a further object of this invention to provide a method for suppression fire which reduces the amount of decomposition products formed from the hydrofluorocarbon fire suppression agents.

In addition to the hydrofluorocarbon agents, inert gases have been recently proposed as replacements for the Halon fire suppression agents (see for example, T. Wysocki, "Inert Gas Fire Suppression Systems Using IG541 (INERGEN): Solving the Hydraulic Calculation Problem," Proceedings of the 1996 Halon Options Technical Working Conference, Albuquerque, N.Mex., May 7–9, 1996). Pure gases such as nitrogen or argon, and also blends such as a 50:50 blend of argon and nitrogen have been proposed.

The inert gas agents are very inefficient at fire suppression, and as a result vast amounts of the inert gas agent must be employed to provide extinguishment. Typical extinguishing concentrations for inert gas agents range from 45 to over 50% by volume, compared to ranges of 5–10% by volume for hydrofluorocarbon fire suppression agents. The large amounts of agent required in the case of the inert gases results in the need for a much larger number of storage vessels compared to the case of the hydrofluorocarbon agents, and as a result large storage areas are required to contain the inert gas system cylinders. For example, in certain situations requiring a single cylinder of a hydrofluorocarbon agent, up to 50 cylinders of an inert gas agent may be required.

It is therefore a further object of this invention to provide a method for suppression of fires which reduces the amount of inert gas required for the suppression of fires, thereby reducing the number of inert gas cylinders required for the protection of a given hazard and reducing the overall cost of the suppression system.

A further disadvantage of the inert gas systems is the high enclosure pressure developed during discharge due to the large amounts of gas which must be injected into the protected enclosure. This can lead to structural damage if the enclosure is not sufficiently vented to allow for leakage and pressure dissipation.

It is a therefore a further object of this invention to provide a method for the extinguishment of fires which reduces the amount of inert gas required to extinguish a fire, hence reducing the high pressure development.

Due to the large amounts of inert gas required for fire suppression, inert gas systems typically discharge their contents into the protected hazard over a one to two minute period. This compares to the case of the fluorocarbon agents, which, because they require much less gas, employ discharge times of 10 seconds or less. Fire extinguishment will not occur until the extinguishing concentration is achieved within the protected enclosure, and hence due to the long discharge times employed with the inert gas agents the fire burns much longer before extinction compared to the case of the fluorocarbon agents. Because the fire burns longer, increased amounts of combustion products are produced with inert gas systems. This is clearly undesirable as it is well documented that small amounts of combustion products (e.g. smoke) can cause extensive equipment damage, and many combustion products are toxic to humans in low concentrations.

It is a further object of the present invention to provide a method for the suppression of fires which reduces the extinguishment time compared to inert gas systems, resulting in reduced amounts of combustion products.

A further problem associated with the use of inert gas suppression agents is depletion of oxygen within the protected hazard to levels dangerous to humans. The amount of oxygen required to sustain human life, and therefore mammalian life, is well known, see for example, Paul Webb, Bioastronautics Data Book, NASA SP-3006, NASA, 1964, page 5. At normal atmospheric pressures at sea level, the unimpaired performance zone is in the range of about 16 to 36 volume percent oxygen. The discharge of the inert gas agents into an enclosure results in oxygen levels significantly below the level of unimpaired performance. For example, at a use level of 50% by volume, a typically employed concentration for inert gas agents, the oxygen within the protected hazard will be reduced to 10.5% due to dilution of the air by the inert gas agent. Further reductions in oxygen will occur due to dilution by the combustion products, resulting in an enclosure environment that is toxic to humans.

It is therefore a further object of this invention to provide a method for fire suppression which does not reduce the oxygen in the protected hazard to unsafe levels.

It is a further object of the present invention to provide a method for the suppression of fires which requires less inert gas agent and less fluorocarbon fire suppression agent than required with conventional inert gas and fluorocarbon suppression systems, leading to more cost effective fire suppression systems.

Further objects of the invention will become apparent from the following description.

DESCRIPTION OF THE PREFERRED EMBODIMENTS

For the purpose of promoting an understanding of the principles of the invention, reference will now be made to preferred embodiments of the invention and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

In accordance with the present invention, it has been found that the use of a hybrid fluorocarbon/inert gas extinguishing system eliminates or significantly reduces the problems described above.

In accordance with one embodiment of the present invention, there is provided a method for extinguishing fires which comprises a system consisting of a fluorocarbon fire suppression agent stored in a suitable cylinder, and an inert gas fire suppression agent stored in a second suitable cylinder. Both the fluorocarbon and inert gas cylinders are connected via the appropriate piping and valves to discharge nozzles located within the hazard being protected. Upon detection of a fire, the suppression system is activated. In one embodiment of the invention, the fluorocarbon agent and the inert gas agent are released from their respective storage cylinders simultaneously, affording delivery of the fluorocarbon and inert gas to the protected hazard at the same time. Typical detection systems, for example smoke detectors, infrared detectors, air sampling detectors, etc. may be employed to activate the system, and a delay between detection and agent delivery may be employed if deemed appropriate to the hazard. In a further embodiment of the invention, upon detection of the fire the inert gas agent is delivered to the enclosure first, and the fluorocarbon agent is delivered at a later time, either during or after the inert gas discharge, depending upon the needs of the particular fire scenario.

It should be understood that fire extinguishing using a "flooding" method, as accomplished in accordance with the present invention, provides sufficient extinguishing agent(s) to flood an entire enclosure or room in which the fire is detected. Assuming perfect mixing of gases in the enclosure, the composition of the gases, including the extinguishing agent(s), at the burning material, is identical to the composition of gases at any other location within the enclosure. However, clearly, it is the composition of gases at the burning material which governs whether a fire can be extinguished and, since the mixing of gases in the enclosure may not be homogeneous early in the extinguishing process, the appended claims refer to the gas composition "at the burning material".

The fluorocarbon agent may be stored in a conventional fire suppression agent storage cylinder fitted with a dip tube to afford delivery of the agent through a piping system. As it well known and practiced widely throughout the industry, the fluorocarbon agent in the cylinder can be superpressurized with nitrogen or another inert gas, typically to levels of 360 or 600 psig. In the case of lower boiling fluorocarbon agents such as trifluoromethane ($CF_3H$), the agent can be stored in and delivered from the cylinder without the use of any superpressurization. Alternatively, the fluorocarbon agent can be stored as a pure material in a suitable cylinder to which is connected a pressurization system. The fluorocarbon agent is stored as the pure liquefied compressed gas in the storage cylinder under its own equilibrium vapor pressure at ambient temperatures, and upon detection of a fire, the fluorocarbon agent cylinder is pressurized by suitable means, and once pressurized to the desired level, the agent delivery is activated. Such a "piston flow" method for delivering a fire suppression agent to an enclosure, and additional fire suppression agents, including perfluorocarbons, and hydrochlorofluorocarbons, useful in accordance with the present invention, have been described in U.S. patent application Ser. No. 09/261,535 to Robin, et. al. (allowed Dec. 1, 1999), hereby incorporated by reference.

Specific fluorocarbon agents useful in accordance with the present invention include compounds selected from the chemical compound classes of the hydrofluorocarbons, and iodofluorocarbons. Specific hydrofluoro-carbons preferred in accordance with the present invention include trifluoromethane ($CF_3H$), pentafluoroethane ($CF_3CF_2H$), 1,1,1,2-tetra-fluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoro-propane ($CF_3CF_2CF_2H$), 1,1,1,3,3,3-hexafluoropropane ($CF_3CH_2CF_3$), 1,1, 1,2,3,3-hexafluoropropane ($CF_3CHFCF_2$ H), 1,1,2,2,3,3-hexafluoropropane ($HCF_2CF_2CF_2H$), and 1,1,1,2,2,3-hexafluoropropane ($CF_3CF_2CH_2F$). Specific iodofluorocarbons useful in accordance with the present invention include $CF_3I$ and $CF_3CF_2I$.

Specific inert gases useful in accordance with the present invention include nitrogen, argon, helium, carbon dioxide, and mixtures thereof.

Unlike conventional inert gas extinguishing systems, the present invention employs the inert gas not to extinguish the fire, but employs the inert gas at concentrations lower than that required for extinguishment. Because the invention employs the inert gas agent for other than extinguishing the fire by itself, the inert gas agent need not be employed at the high concentrations required for extinguishment. The use of lower inert gas concentrations reduces the overall system cost as fewer inert gas cylinders are required for protection of the hazard. Since fewer inert gas cylinders are required, less storage space is required to house the cylinders. Because less inert gas agent is discharged into the enclosure, the pressure developed within the enclosure is reduced, and oxygen levels within the enclosure are not reduced to toxic levels.

In addition to the above benefits, it has been discovered that the present invention affords fire extinguishment at fluorocarbon concentrations unexpectedly lower than that required with conventional fluorocarbon fire suppression systems. This results in significantly lowered overall system costs, as the fluorocarbon agents are expensive and represent the major portion of the cost of a fluorocarbon fire suppression system.

The invention will be further described with reference to the following specific Examples. However, it will be understood that these Examples are illustrative and not restrictive in nature.

EXAMPLE 1

The effect of lowered oxygen levels on the concentration of HFC-227ea (1,1,1,2,3,3,3-heptafluoropropane, $CF_3CHFCF_3$) required for the extinguishment of n-heptane flames was examined in a cup burner apparatus, as described in M. Robin and Thomas F. Rowland, "Development of a Standard Cup Burner Apparatus: NFPA and ISO Standard Methods, 1999 Halon Options Technical Working Conference, Apr. 27–29, 1999, Albuquerque, N.Mex. The cup burner method is a standard method for determining extinguishing concentrations for gaseous extinguishants, and has been adopted in both national and international fire suppression standards, for example NFPA 2001 Standard on Clean Agent Fire Extinguishing Systems and ISO 14520: Gaseous Fire-Extinguishing Systems. A mixture of air, nitrogen and HFC-227ea flowed through a 85 mm (ID) Pyrex chimney around a 28 mm (OD) fuel cup. The chimney consisted of a 533 mm length of 85 mm ID glass pipe. The cup had a 45° ground inner edge. A wire mesh screen and a 76 mm (3 inch) layer of 3 mm (OD) glass beads were employed to provide thorough mixing of air, nitrogen and HFC-227ea. n-Heptane was gravity fed to the cup burner from a liquid fuel reservoir consisting of a 250 mL separatory funnel mounted on a laboratory jack, which allowed for an adjustable and constant liquid fuel level in the cup. The fuel was lit with a propane mini-torch, the chimney was placed on the apparatus, and the air and nitrogen flows initiated. The fuel level was then adjusted such that the ground inner edge of the cup was completely covered. A 90 second preburn period was allowed, and the HFC-227ea concentration in the air stream increased in small increments, with a waiting period of 10 seconds between increases in HFC-227ea flow. After flame extinction, the used fuel was drained and the test repeated several times with fresh fuel. Immediately following flame extinction, a sample of the gas stream at a point near the lip of the cup was collected through a length of plastic tubing attached to a Hamilton 1L precision gas syringe. The sample was then injected into a 1L TEDLAR bag and subjected to gas chromatographic analysis. Calibration was performed by preparing standards in a 1L TEDLAR bag. Results are shown in Table 1.

TABLE 1

Extinguishing Concentrations of HFC-227ea And $N_2$ for n-Heptane Flames

| Run | Air Flow L/min | Nitrogen Flow L/min | HF-227ea Flow L/min | % $O_2$ v/v | HFC-227ea Ext. Conc., % v/v |
|---|---|---|---|---|---|
| 1 | 42.3 | 0.00 | 2.89 | 20.8 | 6.4 |
| 2 | 42.3 | 4.17 | 2.71 | 18.9 | 5.5 |
| 3 | 42.3 | 7.35 | 2.36 | 17.7 | 4.5 |
| 4 | 42.3 | 10.80 | 1.75 | 16.6 | 3.2 |
| 5 | 42.3 | 14.20 | 1.10 | 15.6 | 1.9 |
| 6 | 42.3 | 17.50 | 0.61 | 14.7 | 1.0 |
| 7 | 42.3 | 21.60 | 0.00 | 13.8 | 0.0 |

The results of Table 1 demonstrate that flame extinguishment is achieved with lowered amounts of both the inert gas and the hydrofluorocarbon agent compared to conventional inert gas or hydrofluorocarbon suppression systems. Employing HFC-227ea by itself requires 6.4% v/v HFC-227ea for extinguishment; a conventional nitrogen system would require a concentration of 33.8% v/v nitrogen [Run 7: (100)(21.6)/(21.6+42.3)]. Employing the combination of an inert gas and a hydrofluorocarbon agent of the present invention, for example under the conditions of Run 4, where the oxygen concentration is reduced to 16.6% v/v, extinguishment is afforded at a nitrogen concentration of 19.7% and an HFC-227ea concentration of 3.2%. Hence the requirements for both nitrogen and HFC-227ea have been reduced by approximately 50%, which would lead to a substantial reduction in overall system cost, while avoiding atmospheric conditions that are hazardous to personnel.

Table 2 shows the resulting system requirements for the protection of a 5000 $ft^3$ enclosure with a n-heptane fuel hazard. In each case a single cylinder of HFC-227ea would be required. Employing the combination of an inert gas and a hydrofluorocarbon agent of the present invention, for example under conditions where the oxygen concentration is reduced to 16.6% v/v, the requirements for both nitrogen and HFC-227ea have been reduced by approximately 50% compared to the conventional systems, which would lead to a substantial reduction in overall system cost, while avoiding atmospheric conditions that are hazardous to personnel.

TABLE 2

HFC-227ea System Requirements for 5000 $ft^3$ enclosure: Fuel = n-Heptane

| Desired % $O_2$ in enclosure | % v/v Inert gas required to produce desired % $O_2$ | Inert gas required, $ft^3$ | Inert gas, Number of cylinders required* | % HFC-227ea required for extinction | Weight of HFC-227ea required for extinction, lb. |
|---|---|---|---|---|---|
| 20.8 | 0 | 0 | 0 | 6.4 | 155 |
| 18.9 | 9.1 | 479 | 3 | 5.5 | 132 |
| 17.7 | 14.9 | 907 | 5 | 4.5 | 107 |
| 16.6 | 20.2 | 1128 | 6 | 3.2 | 75 |
| 15.6 | 25.0 | 1439 | 8 | 1.9 | 44 |
| 14.7 | 29.3 | 1736 | 9 | 1.0 | 23 |
| 13.8 | 33.8 | 2052 | 11 | 0 | 0 |

*Employing standard inert gas cylinders containing 201 $ft^3$ of inert gas.

EXAMPLE 2

Example 1 was repeated, employing HFC-125 (pentafluoro-ethane, $CF_3CF_2H$) as the hydrofluorocarbon agent. Results are shown in Tables 3 and 4, where it can be seen that the use of the present invention leads to reduced requirements of both the inert gas and the hydrofluorocarbon agent compared to conventional systems.

TABLE 3

Extinguishing Concentrations of HFC-125 and $N_2$ for n-Heptane Flames

| Run | Air Flow L/min | Nitrogen Flow L/min | HF-227ea Flow L/min | % $O_2$ v/v | HFC-125 Ext. Conc., % v/v |
|---|---|---|---|---|---|
| 1 | 42.3 | 0.00 | 4.05 | 20.8 | 8.7 |
| 2 | 42.3 | 4.17 | 3.45 | 18.9 | 6.9 |
| 3 | 42.3 | 7.35 | 3.00 | 17.7 | 5.7 |
| 4 | 42.3 | 10.80 | 2.39 | 16.6 | 4.3 |
| 5 | 42.3 | 14.20 | 2.47 | 15.6 | 2.5 |
| 6 | 42.3 | 17.50 | 0.85 | 14.7 | 1.4 |
| 7 | 42.3 | 21.60 | 0.00 | 13.8 | 0.0 |

TABLE 4

HFC-125 System Requirements for 5000 $ft^3$ enclosure: Fuel = n-Heptane

| Desired % $O_2$ in enclosure | % v/v Inert gas required to produce desired % $O_2$ | Inert gas required, $ft^3$ | Inert gas, Number of cylinders required* | % HFC-125 required for extinction | Weight of HFC-125 required for extinction, lb. |
|---|---|---|---|---|---|
| 20.8 | 0 | 0 | 0 | 8.7 | 150 |
| 18.9 | 9.1 | 479 | 3 | 6.9 | 117 |
| 17.7 | 14.9 | 907 | 5 | 5.7 | 95 |
| 16.6 | 20.2 | 1128 | 6 | 4.3 | 71 |
| 15.6 | 25.0 | 1439 | 8 | 2.5 | 40 |
| 14.7 | 29.3 | 1736 | 9 | 1.4 | 22 |
| 13.8 | 33.8 | 2052 | 11 | 0.0 | 0 |

*Employing standard inert gas cylinders containing 201 $ft^3$ of inert gas.

Analysis of Tables 1 and 3 shows that the extinguishment of these fires is accomplished by delivering to the fire (1) an amount of an inert gas sufficient to reduce the oxygen concentration to a certain level and (2) an amount of a fluorocarbon agent at a concentration sufficient to provide, when combined with the inert gas, extinguishment of the fire.

Sufficient inert gas is delivered to reduce the oxygen, at the fire, to a level ranging from about 10% to about 20% v/v oxygen, preferably about 14% to 20% v/v oxygen, and more preferably, to provide an atmosphere in which human activity is unimpaired, from about 16% to about 20% v/v oxygen.

Assuming an ambient oxygen level of 21% v/v oxygen, reduction to 10% to 20% oxygen would require an inert gas concentration of from about 52.4 to 4.8% v/v. Reduction of the oxygen level to 14% to 20% v/v would require an inert gas concentration of from 33.3 to 4.8%. Reduction of the oxygen level to 16% to 20% v/v would require an inert gas concentration of from 23.8 to 4.8%.

The concentration of fluorocarbon required for extinguishment depends upon the particular fluorocarbon being employed. For example, from Table 1 it can be seen that in the case of HFC-227ea, the concentration required ranges from about 1% to 6.5% v/v, preferably 1% to 6%, and most preferably from about 3% to 6% v/v. For the case of HFC-125 (Table 3), the concentration of HFC-125 ranges from about 1% to 8% v/v, preferably 1% to 7% v/v, and most preferably from about 4% to 8% v/v.

What is claimed is:

1. A flooding method for suppressing a fire at a burning material comprising delivering to said burning material (a) an inert gas and (b) a gaseous compound, stored as a compressed liquid in a separate container, selected from the group consisting of a hydrofluorocarbon, an iodofluorocarbon, and a mixture thereof, gases (a) and (b) being delivered in a combined concentration sufficient to extinguish the fire, wherein the inert gas (a) is delivered to said burning material in a concentration of at least 5% v/v, and compound (b) is delivered to said burning material in a concentration of at least 1% v/v.

2. A method in accordance with claim 1, wherein each gas (a) and (b) is delivered in less than an extinguishing concentration when used alone.

3. A method in accordance with claim 1, wherein the iodofluorocarbon is $CF_3I$.

4. A method in accordance with claim 1, wherein the inert gas is delivered to the burning material prior to delivering compound (b) to the burning material.

5. A method in accordance with claim 1, wherein compound (b) is delivered to the burning material prior to delivering the inert gas to the burning material.

6. A method in accordance with claim 1, wherein the inert gas and compound (b) are delivered simultaneously to the burning material.

7. A method in accordance with claim 1, wherein compound (b) is selected from the group consisting of trifluoromethane ($CF_3H$), pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), 1,1,1,2,2,3-hexafluoropropane ($CF_3CF_2CH_2F$), and mixtures thereof.

8. A method in accordance with claim 7, wherein the inert gas is selected from the group consisting of nitrogen, argon, helium, carbon dioxide, and mixtures thereof.

9. A method in accordance with claim 1, wherein gases (a) and (b) are delivered to the burning material in quantities sufficient to reduce an oxygen concentration, at the burning material, to less than 20% v/v.

10. A method in accordance with claim 9, wherein gases (a) and (b) are delivered to the burning material in quantities sufficient to reduce the oxygen concentration, at the burning material, to a range of 16% to 20% v/v.

11. A method in accordance with claim 1, wherein the concentration of inert gas at said burning material is in the range of about 5% to about 53% v/v, and the concentration of compound (b) at said burning material is in the range of about 1% to about 9% v/v.

12. A method in accordance with claim 11, wherein the concentration of inert gas at said burning material is in the range of about 5% to about 34% v/v, and the concentration of compound (b) at said burning material is in the range of about 3% to about 9% v/v.

13. A method in accordance with claim 12, wherein the concentration of inert gas at said burning material is in the range of about 5% to about 24% v/v, and the concentration of compound (b) at said burning material is in the range of about 3% to about 9% v/v.

14. A method in accordance with claim 1, wherein the inert gas is delivered to the burning material in an amount sufficient such that the concentration of inert gas at the burning material is in the range of about 5% to about 53% v/v.

15. A method in accordance with claim 14, wherein the inert gas is delivered to the burning material in an amount sufficient such that the concentration of inert gas at the burning material is in the range of about 5% to about 34% v/v.

16. A method in accordance with claim 15, wherein the inert gas is delivered to the burning material in an amount sufficient such that the concentration of inert gas at the burning material is in the range of about 5% to about 24% v/v.

17. A method in accordance with claim 16, wherein the inert gas is delivered to the burning material in an amount sufficient such that the concentration of inert gas at the burning material is about 8% to about 20% v/v.

18. A method in accordance with claim 1, wherein the inert gas is delivered to the burning material in an amount such that the inert gas concentration at the burning material is 53% v/v or less.

19. A method in accordance with claim 18, wherein compound (b) is delivered to the burning material in an amount sufficient such that the concentration of compound (b) at the burning material is in the range of about 1% to about 15% v/v.

20. A method in accordance with claim 19, wherein compound (b) is delivered to the burning material in an amount sufficient such that the concentration of compound (b) at the burning material is in the range of about 1% to about 8% v/v.

21. A method in accordance with claim 20, wherein compound (b) is delivered to the burning material in an amount sufficient such that the concentration of compound (b) at the burning material is in the range of about 1% to about 6.5% v/v.

22. A method in accordance with claim 20, wherein compound (b) is delivered to the burning material in an amount sufficient such that the concentration of compound (b) at the burning material is in the range of about 1% to about 7% v/v.

23. A method in accordance with claim 20, wherein compound (b) is delivered to the burning material in an amount sufficient such that the concentration of compound (b) at the burning material is in the range of about 4% v/v to about 8% v/v.

* * * * *